US009834398B2

(12) United States Patent
Niitsuma et al.

(10) Patent No.: US 9,834,398 B2
(45) Date of Patent: Dec. 5, 2017

(54) SHEET CONVEYING DEVICE, SHEET FEEDER, AND IMAGE FORMING APPARATUS

(71) Applicants: Youhei Niitsuma, Kanagawa (JP); Takeshi Akai, Kanagawa (JP); Ikuhisa Okamoto, Kanagawa (JP); Takehisa Shimazu, Kanagawa (JP); Takaya Ochiai, Kanagawa (JP)

(72) Inventors: Youhei Niitsuma, Kanagawa (JP); Takeshi Akai, Kanagawa (JP); Ikuhisa Okamoto, Kanagawa (JP); Takehisa Shimazu, Kanagawa (JP); Takaya Ochiai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/276,894

(22) Filed: Sep. 27, 2016

(65) Prior Publication Data

US 2017/0108812 A1 Apr. 20, 2017

(30) Foreign Application Priority Data

Oct. 20, 2015 (JP) ..... 2015-206041

(51) Int. Cl.

| | |
|---|---|
| ***B65H 5/38*** | (2006.01) |
| ***G10K 11/00*** | (2006.01) |
| ***G03G 15/00*** | (2006.01) |

(52) U.S. Cl.

CPC ..... *B65H 5/38* (2013.01); *G03G 15/602* (2013.01); *G10K 11/00* (2013.01); *B65H 2515/82* (2013.01); *G03G 2215/0129* (2013.01)

(58) Field of Classification Search

CPC ..... B65H 5/38; B65H 2515/82; B65H 2404/5211; B65H 2404/50;

(Continued)

(56) References Cited

U.S. PATENT DOCUMENTS

| | | | | |
|---|---|---|---|---|
| 9,261,852 | B2 * | 2/2016 | Ishida | G03G 21/1604 |
| 2016/0170355 | A1 | 6/2016 | Heishi et al. | |

(Continued)

FOREIGN PATENT DOCUMENTS

| | | |
|---|---|---|
| JP | 5-008579 | 1/1994 |
| JP | 9-315600 | 12/1997 |

*Primary Examiner* — Patrick Cicchino

(74) *Attorney, Agent, or Firm* — Harness, Dickey & Pierce, P.L.C.

(57) ABSTRACT

A sheet conveying device includes a primary sheet guide including a bending portion to bend a sheet while the sheet slides over the bending portion to change a sheet conveyance direction and a secondary sheet guide disposed opposite the primary sheet guide with an interval between the primary sheet guide and the secondary sheet guide. A noise attenuator intakes and attenuates slide noise generated by the bending portion while the sheet slides over the bending portion. The noise attenuator includes a resonant cavity disposed opposite an outer face of one of the primary sheet guide and the secondary sheet guide. A sound inlet is disposed in proximity to the bending portion and intakes the slide noise generated by the bending portion. A sound guide communicates with the sound inlet and the resonant cavity to guide the slide noise from the sound inlet to the resonant cavity.

20 Claims, 11 Drawing Sheets

(58) Field of Classification Search
CPC .. B65H 2404/5213; B65H 2404/52131; B65H 2404/52132; B65H 2404/539
See application file for complete search history.

(56) References Cited

U.S. PATENT DOCUMENTS

| | | | | |
|---|---|---|---|---|
| 2017/0053633 | A1* | 2/2017 | Ishida | G10K 11/172 |
| 2017/0180586 | A1* | 6/2017 | Ochiai | H04N 1/00976 |
| 2017/0183178 | A1* | 6/2017 | Kuroki | B41J 29/02 |

* cited by examiner

SHEET CONVEYING DEVICE, SHEET FEEDER, AND IMAGE FORMING APPARATUS

CROSS-REFERENCE TO RELATED APPLICATION

This patent application is based on and claims priority pursuant to 35 U.S.C. §119 to Japanese Patent Application No. 2015-206041, filed on Oct. 20, 2015, in the Japanese Patent Office, the entire disclosure of which is hereby incorporated by reference herein.

BACKGROUND

Technical Field

Example embodiments generally relate to a sheet conveying device, a sheet feeder, and an image forming apparatus, and more particularly, to a sheet conveying device for conveying a sheet, a sheet feeder incorporating the sheet conveying device, and an image forming apparatus incorporating the sheet conveying device.

Background Art

Related-art image forming apparatuses, such as copiers, facsimile machines, printers, or multifunction peripherals having two or more of copying, printing, scanning, facsimile, plotter, and other functions, typically form an image on a recording medium according to image data.

Such image forming apparatus includes a body, an image scanner disposed atop the body, and an auto document feeder (ADF) disposed atop the image scanner. In order to downsize the ADF, the ADF includes an original tray and an ejection tray situated below the original tray. A user places an original sheet bearing an image to be read by the image scanner on the original tray. The ejection tray receives the original sheet bearing the image that has been read by the image scanner. A sheet conveying device conveys the original sheet from the original tray to the ejection tray.

The image forming apparatus may be a multifunction peripheral including a sheet conveying device that conveys a recording sheet onto which an image is formed with toner, ink, or the like according to image data sent from the image scanner or a client computer connected to the multifunctional peripheral.

While the original sheet or the recording sheet is conveyed through the sheet conveying device, the original sheet or the recording sheet slides over a component disposed inside the sheet conveying device, generating slide noise. The slide noise leaks out of the image forming apparatus as undesired noise, degrading an environment of the image forming apparatus.

SUMMARY

At least one embodiment provides a novel sheet conveying device that includes a conveyer to convey a sheet and a primary sheet guide including a bending portion to bend the sheet while the sheet slides over the bending portion to change a sheet conveyance direction. A secondary sheet guide is disposed opposite the primary sheet guide with an interval between the primary sheet guide and the secondary sheet guide. A noise attenuator intakes and attenuates slide noise generated by the bending portion while the sheet slides over the bending portion. The noise attenuator includes at least one resonant cavity disposed opposite an outer face of one of the primary sheet guide and the secondary sheet guide, at least one sound inlet, disposed in proximity to the bending portion, to intake the slide noise generated by the bending portion, and at least one sound guide communicating with the sound inlet and the resonant cavity to guide the slide noise from the sound inlet to the resonant cavity.

At least one embodiment further provides a novel sheet feeder that includes a roller pair to feed a sheet and a sheet conveying device to convey the sheet fed by the roller pair. The sheet conveying device includes a conveyer to convey the sheet and a primary sheet guide including a bending portion to bend the sheet while the sheet slides over the bending portion to change a sheet conveyance direction. A secondary sheet guide is disposed opposite the primary sheet guide with an interval between the primary sheet guide and the secondary sheet guide. A noise attenuator intakes and attenuates slide noise generated by the bending portion while the sheet slides over the bending portion. The noise attenuator includes at least one resonant cavity disposed opposite an outer face of one of the primary sheet guide and the secondary sheet guide, at least one sound inlet, disposed in proximity to the bending portion, to intake the slide noise generated by the bending portion, and at least one sound guide communicating with the sound inlet and the resonant cavity to guide the slide noise from the sound inlet to the resonant cavity.

At least one embodiment further provides a novel image forming apparatus that includes an image scanner to read an image on a sheet and a sheet conveying device to convey the sheet to the image scanner. The sheet conveying device includes a conveyer to convey the sheet and a primary sheet guide including a bending portion to bend the sheet while the sheet slides over the bending portion to change a sheet conveyance direction. A secondary sheet guide is disposed opposite the primary sheet guide with an interval between the primary sheet guide and the secondary sheet guide. A noise attenuator intakes and attenuates slide noise generated by the bending portion while the sheet slides over the bending portion. The noise attenuator includes at least one resonant cavity disposed opposite an outer face of one of the primary sheet guide and the secondary sheet guide, at least one sound inlet, disposed in proximity to the bending portion, to intake the slide noise generated by the bending portion, and at least one sound guide communicating with the sound inlet and the resonant cavity to guide the slide noise from the sound inlet to the resonant cavity.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
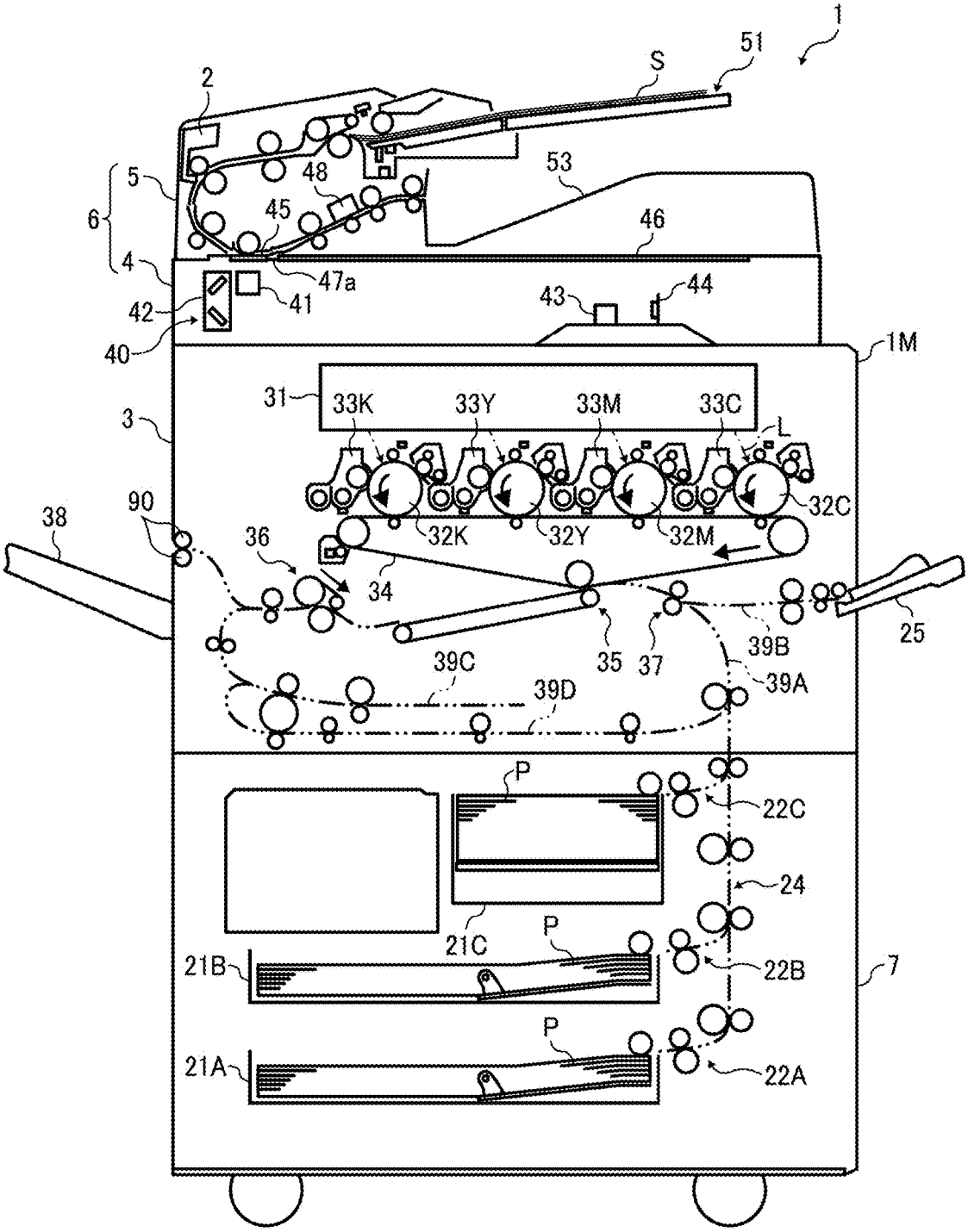
FIG. 1 is a schematic vertical cross-sectional view of an image forming apparatus according to an example embodiment of the present disclosure.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors used herein are interpreted accordingly.

Although the terms first, second, and the like may be used herein to describe various elements, components, regions, layers and/or sections, it should be understood that these elements, components, regions, layers and/or sections should not be limited by these terms. These terms are used to distinguish one element, component, region, layer, or section from another region, layer, or section. Thus, a first element, component, region, layer, or section discussed below could be termed a second element, component, region, layer, or section without departing from the teachings of the present disclosure.

The terminology used herein is for the purpose of describing particular embodiments and is not intended to be limiting of the present disclosure. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic vertical cross-sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 1 is a color MFP that forms a color toner image on a recording medium by electrophotography. Alternatively, the image forming apparatus 1 may be a monochrome MFP that forms a monochrome toner image on a recording medium. Yet alternatively, the image forming apparatus 1 may form an image on a recording medium by inkjet printing.

Referring to FIG. 1, a description is provided of a construction of the image forming apparatus 1.

As illustrated in FIG. 1, the image forming apparatus 1 is a digital multifunction peripheral including a body 1M and an auto document feeder (ADF) 5 disposed atop the body 1M. The body 1M includes a sheet feeding device 7, an image forming device 3, and an image scanner 4. The image scanner 4 and the ADF 5 construct an image reading device 6. The ADF 5 serves as a sheet feeder. The ADF 5 includes a noise attenuator 2 described below.

A detailed description is now given of a construction of the sheet feeding device 7.

The sheet feeding device 7 includes three paper trays 21A, 21B, and 21C being layered vertically and loading a plurality of sheets P serving as recording media of different sizes, respectively. Each of the paper trays 21A, 21B, and 21C loads the sheets P (e.g., plain paper) having a size selected from the different sizes in portrait orientation or landscape orientation.

The sheet feeding device 7 includes a plurality of sheet feeders 22A, 22B, and 22C that picks up and separates an uppermost sheet P from other sheets P placed on the paper trays 21A, 21B, and 21C and feeds the uppermost sheet P to conveyance rollers, respectively. The sheet feeding device 7 further includes a sheet feeding path 24 provided with the conveyance rollers that convey the sheet P conveyed from one of the sheet feeders 22A, 22B, and 22C to a given image forming position inside the image forming device 3.

A detailed description is now given of a construction of the image forming device 3.

The image forming device 3 includes an exposure device 31, a plurality of photoconductive drums 32K, 32Y, 32M, and 32C, a plurality of developing devices 33K, 33Y, 33M, and 33C replenished with toners in different colors, that is, black, yellow, magenta, and cyan toners, respectively, a transfer belt 34, a secondary transfer device 35, and a fixing device 36.

The exposure device 31 generates laser beams L according to black, yellow, magenta, and cyan image data created by the image reading device 6, which expose the photoconductive drums 32K, 32Y, 32M, and 32C, respectively. The exposure device 31 exposes the photoconductive drums 32K, 32Y, 32M, and 32C with the laser beams L, forming electrostatic latent images corresponding to the black, yellow, magenta, and cyan image data on an outer circumferential surface of the photoconductive drums 32K, 32Y, 32M, and 32C, respectively.

The developing devices 33K, 33Y, 33M, and 33C disposed in proximity to the photoconductive drums 32K, 32Y, 32M, and 32C supply the black, yellow, magenta, and cyan toners to the electrostatic latent images formed on the photoconductive drums 32K, 32Y, 32M, and 32C so that the black, yellow, magenta, and cyan toners construct thin layers, thus developing the electrostatic latent images into visible black, yellow, magenta, and cyan toner images, respectively.

The black, yellow, magenta, and cyan toner images formed on the photoconductive drums 32K, 32Y, 32M, and 32C are primarily transferred onto the transfer belt 34. The secondary transfer device 35 disposed in proximity to the transfer belt 34 secondarily transfers the black, yellow, magenta, and cyan toner images from the transfer belt 34 onto the sheet P conveyed from the sheet feeding device 7, thus forming a color toner image on the sheet P. The fixing device 36 melts and fixes the color toner image on the sheet P under heat and pressure.

The image forming device 3 further includes a conveyance path 39A through which the sheet P conveyed from the sheet feeding path 24 of the sheet feeding device 7 is further conveyed to the secondary transfer device 35. The conveyance path 39A is provided with a registration roller pair 37 that adjusts a conveyance time and a conveyance speed of the sheet P. The sheet P is conveyed through a secondary transfer nip formed between the transfer belt 34 and the secondary transfer device 35 at a conveyance speed equivalent to a rotation speed of the transfer belt 34. After the sheet P passes through the secondary transfer nip and the fixing device 36, the sheet P is ejected onto an output tray 38 by an output roller pair 90.

The image forming device 3 further includes a bypass tray 25 that loads a plurality of sheets P and a bypass conveyance path 39B that delivers a sheet P from the bypass tray 25 to the conveyance path 39A at a position upstream from the registration roller pair 37 in a sheet conveyance direction.

Below the secondary transfer device 35 and the fixing device 36 are a switchback conveyance path 39C and a reverse conveyance path 39D, each of which includes a plurality of conveyance rollers and conveyance guides.

If the image forming apparatus 1 receives a duplex print job to form a toner image on both sides of the sheet P, the switchback conveyance path 39C performs switchback conveying to feed back and convey the sheet P bearing a toner image on a front side thereof to the reverse conveyance path 39D.

The reverse conveyance path 39D reverses the sheet P conveyed from the switchback conveyance path 39C and conveys the sheet P to the registration roller pair 37.

Thus, the switchback conveyance path 39C feeds back the sheet P bearing the toner image on the front side thereof and the reverse conveyance path 39D reverses and conveys the sheet P to the registration roller pair 37 which conveys the sheet P to the secondary transfer nip. As the sheet P is conveyed through the secondary transfer nip, the secondary transfer device 35 secondarily transfers another toner image formed on the transfer belt 34 onto a back side of the sheet P. After the fixing device 36 fixes the toner image on the sheet P, the sheet P is ejected onto the output tray 38 by the output roller pair 90.

A detailed description is now given of a construction of the image scanner 4.

The image scanner 4 includes a first carriage 41 mounting a light source (e.g., a lighting unit) and a mirror, a second carriage 42 mounting a mirror, an image forming lens 43, an imaging device 44, and a first exposure glass 45. The above-described components of the image scanner 4 are situated in the body 1M and construct a first side reader 40 that reads an image on a first side (e.g., a front side) of a sheet S (e.g., an original sheet) conveyed over the first exposure glass 45. The first side of the sheet S is one side of the sheet S, for example, the front side of the sheet S, conveyed automatically by the ADF 5.

The image scanner 4 further includes a second exposure glass 46 on which a sheet S (e.g., an original sheet) bearing an image is placed and an abutment 47*a* to abut on one edge of the sheet S to position the sheet S on the second exposure glass 46.

The first carriage 41 is disposed below the first exposure glass 45 and the second exposure glass 46 such that the first carriage 41 is movable horizontally and positioned adjustably. Light emitted by the light source is reflected by the mirror and irradiates the sheet S through the first exposure glass 45 or the second exposure glass 46. The light reflected by the sheet S is deflected by the mirrors mounted on the first carriage 41 and the second carriage 42, respectively, and enters the image forming lens 43 to form an image in the imaging device 44 that produces image data.

For example, while the light source is energized, the first carriage 41 moves at a speed that is twice as great as a speed of the second carriage 42 to allow the light to irradiate and scan the sheet S placed on the second exposure glass 46. While the light irradiates the sheet S, the imaging device 44 reads the image on the sheet S. Thus, the image scanner 4 performs stationary original reading, that is, flat bed scanning.

The first carriage 41 halts at a home position immediately below the first exposure glass 45. While an optical system including the light source and the mirrors halts, the first carriage 41 reads the image on the first side of the sheet S conveyed by the ADF 5. Thus, the image scanner 4 performs moving original reading, that is, document feeding (DF) scanning.

In addition to the first side reader 40 situated inside the image scanner 4, the image forming apparatus 1 includes a second side reader 48 situated inside the ADF 5. The second side reader 48 reads an image on a second side (e.g., a back side) of the sheet S after the sheet S passes over the first exposure glass 45.

A detailed description is now given of a construction of the ADF 5.

The ADF 5 is coupled to a top face of the body 1M such that the ADF 5 is pivotable about a hinge. As the ADF 5 is lifted, the ADF 5 moves to an open position where the ADF 5 exposes the first exposure glass 45 and the second exposure glass 46 of the image scanner 4. Conversely, as the ADF 5 is lowered, the ADF 5 moves to a close position where the ADF 5 covers the first exposure glass 45 and the second exposure glass 46.

Figure 2:
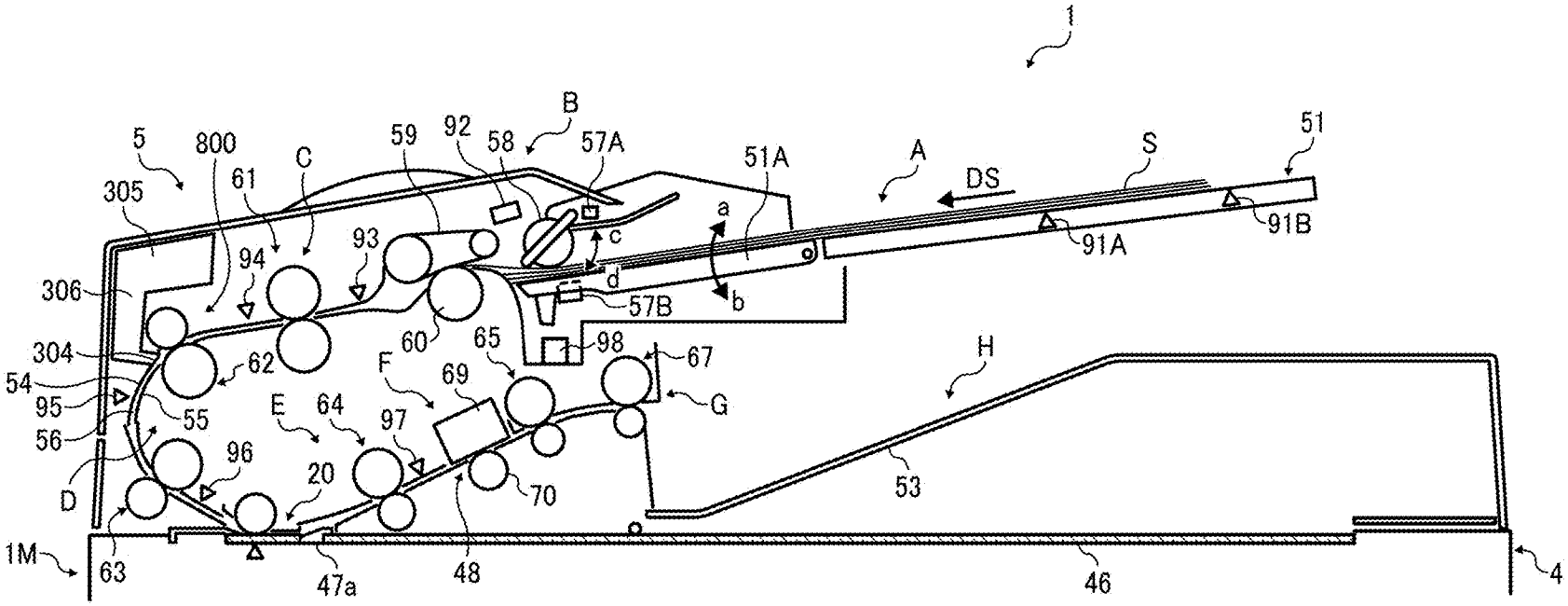
FIG. 2 is a cross-sectional view of an auto document feeder incorporated in the image forming apparatus depicted in FIG. 1.
Figure 3:
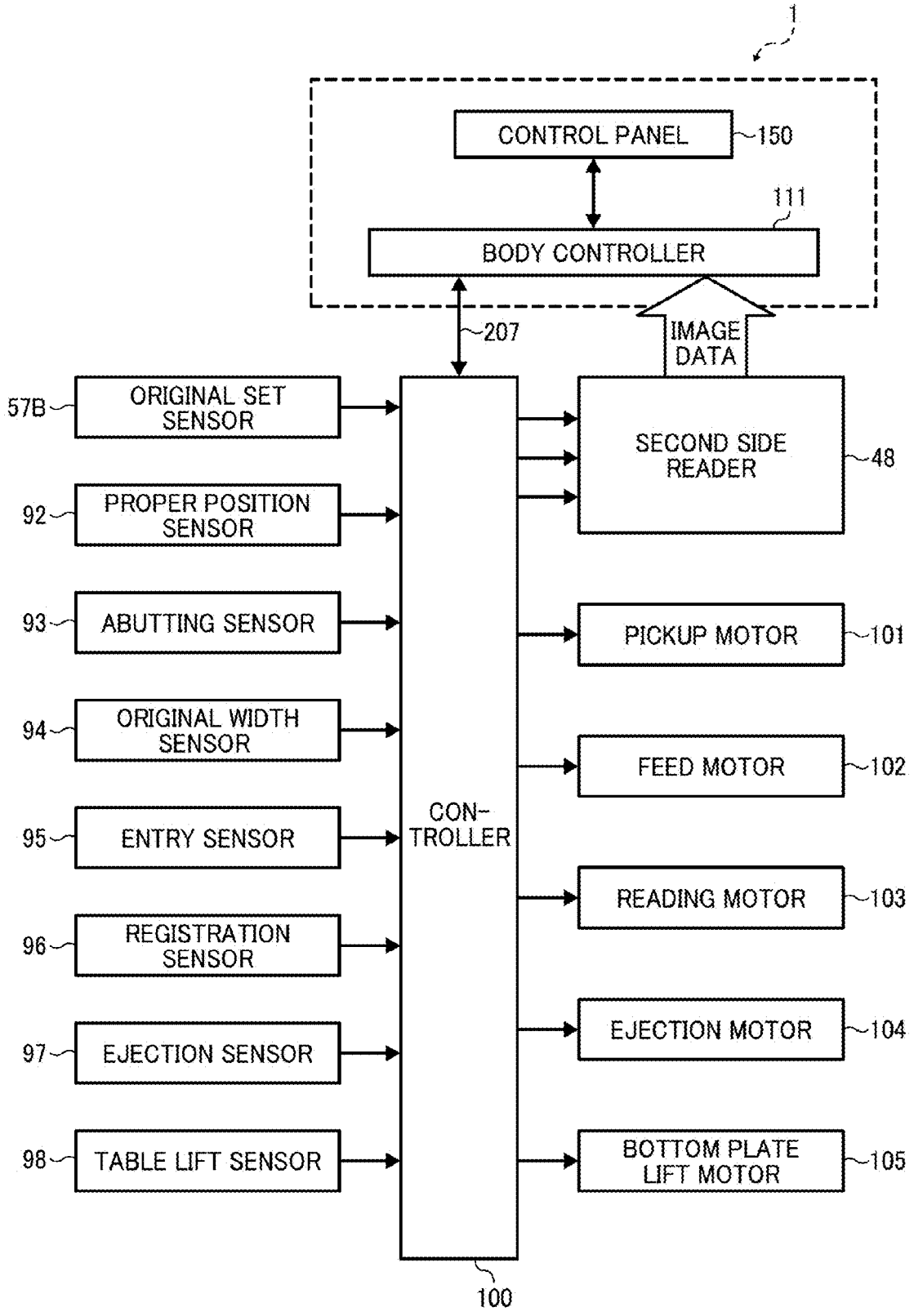
FIG. 3 is a block diagram of the image forming apparatus depicted in FIG. 1, illustrating control of the auto document feeder depicted in FIG. 2.
Figure 4:
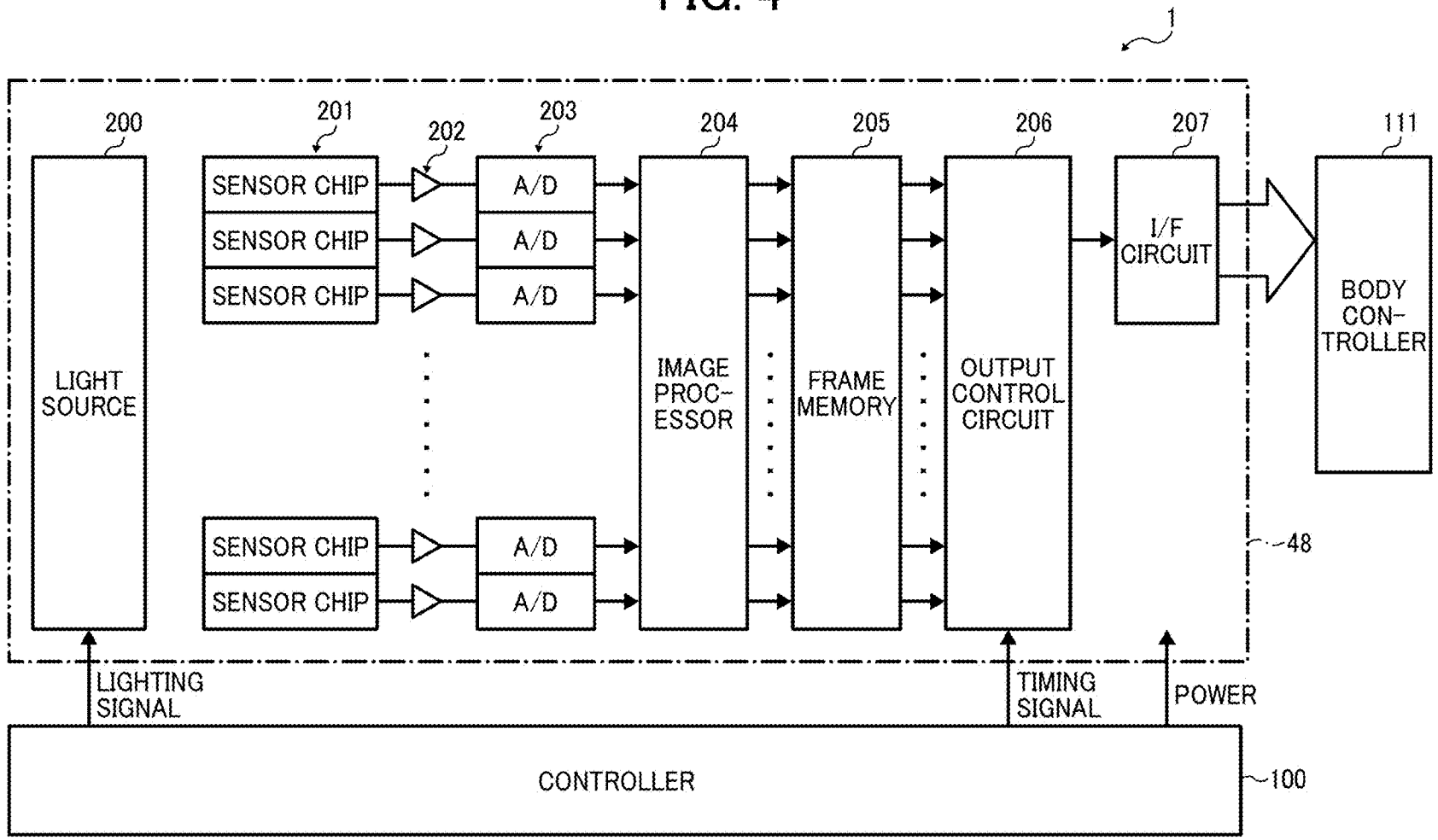
FIG. 4 is a block diagram of the image forming apparatus depicted in FIG. 1, illustrating transmission of signals between the auto document feeder depicted in FIG. 2 and a body of the image forming apparatus.

Referring to FIGS. 2 to 4, a description is provided of the construction of the ADF 5 in more detail.

FIG. 2 is a cross-sectional view of the ADF 5. FIG. 3 is a block diagram of the image forming apparatus 1, illustrating control of the ADF 5. FIG. 4 is a block diagram of the image forming apparatus 1, illustrating transmission of signals between the ADF 5 and the body M1 of the image forming apparatus 1.

As illustrated in FIG. 2, the ADF 5 further includes an original set portion A, a separate-feed portion B, a registration portion C, a turn portion D, a first read-convey portion E, a second read-convey portion F, an ejection portion G, and a stack portion H. As illustrated in FIG. 3, the image forming apparatus 1 further includes a plurality of drivers that drives the original set portion A, the separate-feed portion B, the registration portion C, the turn portion D, the first read-convey portion E, the second read-convey portion F, and the ejection portion G to convey the sheet S, that is, a pickup motor 101, a feed motor 102, a reading motor 103, an ejection motor 104, and a bottom plate lift motor 105. The image forming apparatus 1 further includes a controller 100 that controls the pickup motor 101, the feed motor 102, the reading motor 103, the ejection motor 104, and the bottom plate lift motor 105.

As illustrated in FIG. 2, the ADF 5 employs a sheet-through feeding method. The original set portion A loads a plurality of sheets S facing up, each of which bears an image to be read at least on the first side of the sheet S. For duplex printing, an image on the second side of the sheet S faces down. The separate-feed portion B separates a single sheet S from other sheets S placed on the original set portion A and feeds the single sheet S to the registration portion C. The registration portion C contacts and temporarily halts the sheet S conveyed from the separate-feed portion B to correct skew of the sheet S and feeds the sheet S to the turn portion D. The turn portion D turns the sheet S conveyed from the registration portion C to direct the image on the sheet S to face down and conveys the sheet S to the first read-convey portion E. The first read-convey portion E allows the image on the sheet S conveyed from the turn portion D to be read by the image scanner 4 through the first exposure glass 45 and conveys the sheet S to the second read-convey portion F. The second read-convey portion F reads the image on the second side of the sheet S and conveys the sheet S to the ejection portion G. The ejection portion G ejects the sheet S to an outside of the ADF 5. The stack portion H receives and stacks the sheet S.

A detailed description is now given of a construction of the original set portion A. As illustrated in FIG. 2, a user places the plurality of sheets S on an original table 51 incorporating a movable original table 51A such that the image on the first side of each sheet S faces up. The user moves a side guide in a width direction of the sheets S that is perpendicular to a sheet conveyance direction DS to restrict and position the sheets S in the width direction thereof. A set feeler 57A and an original set sensor 57B detect the position of the sheet S and send a signal to a body controller 111 through an interface (I/F) circuit 207 depicted in FIG. 3.

A plurality of original length sensors 91A and 91B mounted on the original table 51 detects a schematic length of the sheet S in the sheet conveyance direction DS. Each of the original length sensors 91A and 91B is a reflection sensor or an actuator type sensor that detects the sheet S even when the single sheet S is placed on the original table 51.

The bottom plate lift motor 105 depicted in FIG. 3 lifts and lowers the movable original table 51A in directions a and b depicted in FIG. 2. As the set feeler 57A and the original set sensor 57B detect the sheet S placed on the original table 51, the controller 100 rotates the bottom plate lift motor 105 forward to lift the movable original table 51A until an uppermost sheet S of the plurality of sheets S placed on the original table 51 contacts a pickup roller 58.

A proper position sensor 92 detects the uppermost sheet S lifted by the movable original table 51A to a proper height. When the proper position sensor 92 is turned on, the controller 100 controls the bottom plate lift motor 105 to stop the movable original table 51A. When the sheets S are fed repeatedly and the height of the uppermost sheet S is lowered gradually, the proper position sensor 92 is turned off. The controller 100 controls the bottom plate lift motor 105 repeatedly to lift the movable original table 51A until the proper position sensor 92 is turned on again. Thus, the uppermost sheet S is retained at the proper height constantly.

When the sheets S have been fed from the original table 51 and therefore the original table 51 is clear, the controller 100 rotates the bottom plate lift motor 105 backward to lower the movable original table 51A to a home position where the user sets a next sheaf of sheets S on the original table 51.

The pickup motor 101 and a cam rotate the pickup roller 58 in directions c and d depicted in FIG. 2. As the movable original table 51A is lifted, the uppermost original S pushes up the pickup roller 58 placed on the movable original table 51A in the direction c so that the proper position sensor 92 detects the uppermost original S. The user presses a key on a control panel 150 depicted in FIG. 3 to select a one-sided print mode to form a toner image on one side of a sheet P or a two-sided print mode to form a toner image on both sides of a sheet P. Thereafter, the user presses a print key on the control panel 150 to start printing. As an original feeding signal is transmitted from the body controller 111 to the controller 100 through the interface circuit 207, the controller 100 rotates the feed motor 102 forward to drive and rotate the pickup roller 58. Thus, the pickup roller 58 picks up several sheets S, preferably a single sheet S, from the plurality of sheets S placed on the original table 51. The pickup roller 58 rotates in a rotation direction that directs the uppermost sheet S to an original inlet of the separate-feed portion B.

The user may select the one-sided print mode or the two-sided print mode for a whole sheaf of sheets S placed on the original table 51. Alternatively, the user may select different modes for a part and another part of the sheaf of sheets S. For example, when ten sheets S are placed on the original table 51, the user may select the two-sided print mode for a first sheet S and a tenth sheet S and the one-sided print mode for second to ninth sheets S.

A detailed description is now given of a construction of the separate-feed portion B.

The controller 100 rotates the feed motor 102 forward to drive and rotate a feed belt 59 in the sheet conveyance direction DS. The controller 100 rotates the feed motor 102 forward to drive and rotate a reverse roller 60 in a direction opposite the sheet conveyance direction DS. Accordingly, the reverse roller 60 separates the uppermost sheet S from underneath sheets S to feed the uppermost sheet S to the registration portion C. For example, while the reverse roller 60 is in direct contact with and pressed against the feed belt 59 with given pressure or the reverse roller 60 is pressed against the feed belt 59 via the single sheet S, the reverse roller 60 rotates counterclockwise in FIG. 2 in accordance with rotation of the feed belt 59. If two or more sheets S enter a nip formed between the feed belt 59 and the reverse roller 60 accidentally, a rotation force of the feed belt 59 that rotates the reverse roller 60 is set to be smaller than a torque of a torque limiter. Accordingly, the reverse roller 60 rotates clockwise in FIG. 2 in a default rotation direction to feed back the underneath sheets S to the original table 51, preventing multiple feeding of the sheets S.

The feed belt 59 conveys the uppermost sheet S separated from the underneath sheets S by the feed belt 59 and the reverse roller 60 to an abutting sensor 93. The abutting sensor 93 detects a leading edge of the sheet S.

A detailed description is now given of a construction of the registration portion C.

The sheet S is conveyed to a pullout roller pair 61 and the leading edge of the sheet S comes into contact with the pullout roller pair 61 that is halted. The sheet S is further conveyed for a given amount after the abutting sensor 93 detects the sheet S. When the sheet S is pressed against the pullout roller pair 61 and bent for a given amount, the controller 100 halts the feed motor 102 to halt the feed belt 59. The controller 100 rotates the pickup motor 101 to retract the pickup roller 58 from an upper face of the sheet S to cause the feed belt 59 to convey the sheet S. As the leading edge of the sheet S enters a nip formed between an upper roller and a lower roller constructing the pullout roller pair 61, the pullout roller pair 61 contacts the leading edge of the sheet S to correct skew of the sheet S.

The pullout roller pair 61 corrects skew of the sheet S and conveys the sheet S to an intermediate roller pair 62. The controller 100 rotates the feed motor 102 backward to drive and rotate the pullout roller pair 61. While the feed motor 102 rotates backward, the pullout roller pair 61 and the intermediate roller pair 62 are driven and the pickup roller 58 and the feed belt 59 are not driven. The pullout roller pair 61, the intermediate roller pair 62, the pickup roller 58, and the feed belt 59 serve as a conveyer that conveys the sheet S.

A detailed description is now given of a construction of the turn portion D.

A plurality of original width sensors 94 is aligned in a depth direction of the ADF 5 that is parallel to the width direction of the sheet S and perpendicular to the sheet conveyance direction DS. The original width sensors 94 detect a width of the sheet S in the width direction thereof that is conveyed by the pullout roller pair 61. The controller 100 calculates a length of the sheet S in the sheet conveyance direction DS based on a motor pulse defined when the abutting sensor 93 detects the leading edge and a trailing edge of the sheet S.

While the pullout roller pair 61 and the intermediate roller pair 62 are driven and rotated to convey the sheet S from the registration portion C to the turn portion D, a conveyance speed at which the sheet S is conveyed through the registration portion C is higher than a conveyance speed at which the sheet S is conveyed through the first read-convey portion E to shorten a conveyance time to convey the sheet S to the first read-convey portion E.

A detailed description is now given of a construction of the first read-convey portion E.

When an entry sensor 95 detects the leading edge of the sheet S, before the leading edge of the sheet S enters a nip formed between an upper roller and a lower roller constructing an entry roller pair 63, the controller 100 starts decreasing the conveyance speed of the sheet S to cause a conveyance speed at which the entry roller pair 63 conveys the sheet S through the first read-convey portion E to be equivalent to a conveyance speed at which the first read-convey portion E conveys the sheet S while reading the image on the sheet S.

Simultaneously, the controller 100 rotates the reading motor 103 forward to drive and rotate the entry roller pair 63, an exit roller pair 64, and a contact image sensor (CIS) exit roller pair 65. When a registration sensor 96 detects the leading edge of the sheet S, the conveyance speed of the sheet S is decreased while the sheet S is conveyed for a given distance. When the sheet S halts temporarily before a reading position 20, the controller 100 transmits a registration position stop signal to the body controller 111 through the interface circuit 207. When the controller 100 receives a reading start signal from the body controller 111, the sheet S halted at a registration position is conveyed at an accelerated speed so that the sheet S is conveyed at a given conveyance speed before the leading edge of the sheet S reaches the reading position 20. At a time when the leading edge of the sheet S detected by a pulse count of the reading motor 103 reaches the reading position 20, the controller 100 transmits a gate signal indicating a valid imaged region in a sub-scanning direction on the first side of the sheet S to the body controller 111 until the trailing edge of the sheet S passes through the reading position 20.

A detailed description is now given of a construction of the ejection portion G and the stack portion H.

In the one-sided print mode, the sheet S having passed through the first read-convey portion E is conveyed to the ejection portion G through the second side reader 48. When an ejection sensor 97 detects the leading edge of the sheet S, the controller 100 rotates the ejection motor 104 forward to rotate an ejection roller pair 67 counterclockwise in FIG. 2. Based on a pulse count of the ejection motor 104 counted after the ejection sensor 97 detects the leading edge of the sheet S, the controller 100 deceases a rotation speed of the ejection motor 104 immediately before the trailing edge of the sheet S is ejected from a nip formed between an upper roller and a lower roller constructing the ejection roller pair 67, thus preventing the sheet S ejected by the ejection roller pair 67 onto an ejection tray 53 from protruding beyond the ejection tray 53. The entry roller pair 63, the exit roller pair 64, the CIS exit roller pair 65, and the ejection roller pair 67 serve as a conveyer that conveys the sheet S.

A detailed description is now given of a construction of the second read-convey portion F.

In the two-sided print mode, at a time when the leading edge of the sheet S reaches the second side reader 48, which is determined based on a pulse count of the reading motor 103 counted after the ejection sensor 97 detects the leading edge of the sheet S, the controller 100 transmits a gate signal indicating a valid imaged region in the sub-scanning direction on the second side of the sheet S to the second side reader 48 until the trailing edge of the sheet S passes through the second side reader 48. A second reading roller 70 prevents the sheet S from being lifted while the sheet S is conveyed through the second side reader 48. The second reading roller 70 also serves as a reference white portion to obtain shading data in the second side reader 48.

Referring to FIG. 3, a description is provided of a configuration that controls an operation of the ADF 5.

As illustrated in FIG. 3, the image forming apparatus 1 includes the controller 100 that controls the ADF 5, the body controller 111 that controls the components disposed inside the body 1M depicted in FIG. 1, and the control panel 150 coupled to the body controller 111.

The controller 100 receives a detection signal sent from each of the original set sensor 57B, the proper position sensor 92, a table lift sensor 98, the abutting sensor 93, the original width sensors 94, the entry sensor 95, the registration sensor 96, and the ejection sensor 97.

The controller 100 drives the pickup motor 101 that drives and rotates the pickup roller 58, the feed motor 102 that drives and rotates the feed belt 59, the pullout roller pair 61, and the intermediate roller pair 62, and the reading motor 103 that drives and rotates the entry roller pair 63, the exit roller pair 64, and the CIS exit roller pair 65. The controller 100 drives the ejection motor 104 that drives and rotates the ejection roller pair 67 and the bottom plate lift motor 105 that lifts the movable original table 51A.

The controller 100 sends a timing signal and the like to the second side reader 48. The timing signal notifies a time when the leading edge of the sheet S reaches a reading position where a second side scanning unit 69 reads an image on the second side of the sheet S. Image data created after the timing signal is recognized as valid data.

The controller 100 is connected to the body controller 111 through the interface circuit 207. When the user presses the print key on the control panel 150, the body controller 111 sends an original feed signal and a reading start signal to the controller 100 through the interface circuit 207.

Referring to FIG. 4, a description is provided of a signal path between the ADF 5 and the body M1 of the image forming apparatus 1.

As illustrated in FIG. 4, the second side reader 48 includes a light source 200 including a light-emitting diode (LED) array, a fluorescent lamp, or a cold cathode tube. The light source 200 emits light onto the sheet S according to a lighting signal sent from the controller 100. The second side reader 48 receives from the controller 100 the timing signal that notifies the time when the leading edge of the sheet S reaches the reading position where the second side scanning unit 69 reads the image on the second side of the sheet S. The second side reader 48 also receives power to be supplied to the light source 200.

The second side reader 48 further includes a plurality of sensor chips 201, a plurality of operational (OP) amplifier circuits 202, and a plurality of analog digital (A/D) converters 203. The plurality of sensor chips 201 is aligned in a main scanning direction. The plurality of OP amplifier circuits 202 is coupled to the plurality of sensor chips 201, respectively. The plurality of A/D converters 203 is coupled to the plurality of OP amplifier circuits 202, respectively. The second side reader 48 further includes an image processor 204, a frame memory 205, an output control circuit 206, and the interface circuit 207.

The sensor chip 201 includes a photoelectric transducer called an equal magnification contact image sensor and a condenser lens. The condenser lens of each of the plurality of the sensor chips 201 condenses reflection light reflected by the second side of the sheet S into the photoelectric transducer which reads the reflection light into image data.

The OP amplifier circuits 202 amplify the image data created by the sensor chips 201, respectively. Thereafter, the A/D converters 203 convert the amplified image data into digital image data.

The digital image data enters the image processor 204 which performs shading correction and the like on the digital image data. Thereafter, the frame memory 205 stores the digital image data temporarily. The output control circuit 206 converts the digital image data into image data having a data format acceptable by the body controller 111. Thereafter, the digital image data enters the body controller 111 through the interface circuit 207.

The turn portion D depicted in FIG. 2 includes a bending portion that changes the sheet conveyance direction DS substantially. While the sheet S slides over the bending portion frictionally, slide noise may occur from the bending portion. To address this circumstance, the turn portion D includes the noise attenuator 2 depicted in FIG. 1 that attenuates the slide noise.

Figure 5:
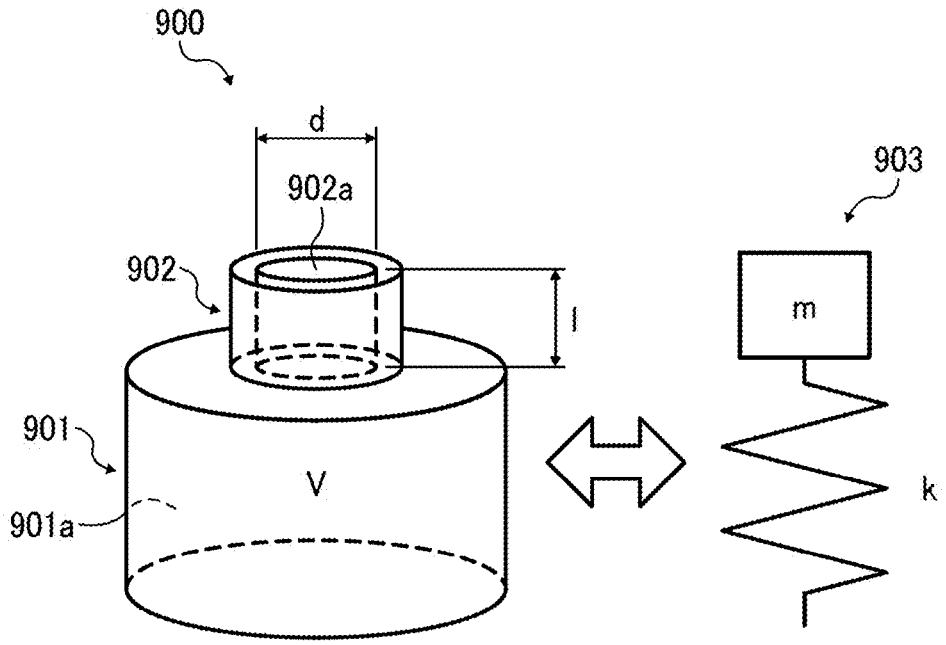
FIG. 5 is a perspective view of a Helmholtz resonator.

Referring to FIG. 5, a description is provided of Helmholtz resonance relating to the noise attenuator 2 of the turn portion D.

FIG. 5 is a perspective view of a Helmholtz resonator 900. As illustrated in FIG. 5, the Helmholtz resonator 900 includes a body 901 including a cavity 901*a* having a volume V and a neck 902 including a through-hole 902*a* (e.g., an inlet) having a diameter d and a length l. As a sonic wave enters the through-hole 902*a* from an outside of the Helmholtz resonator 900, the sonic wave involves air in the through-hole 902*a* into the cavity 901*a* as the sonic wave presses the air into the cavity 901*a*. Pressure sealed inside the body 901 increases and presses the air back to the through-hole 902*a*. Although the air is pressed back to the outside of the through-hole 902*a*, the air returns to the through-hole 902*a* by inertia. Such repeated motion of the air defines a spring 903 with simple harmonic oscillation, which has a mass m and a spring constant k. Hence, a resonance frequency f is calculated by a following formula (1). Even if the neck 902 includes a plurality of through-holes 902*a* that corresponds to the single cavity 901*a*, cross-sectional areas of the through-holes 902*a* are combined into a cross-sectional area S in the formula (1) to calculate the resonance frequency f.

$$f = \frac{C}{2\pi}\sqrt{\frac{S}{(1+\delta)V}} \tag{1}$$

In the formula (1), f represents the resonance frequency in hertz (Hz). C represents a sound velocity in meter per second (m/s). S represents a cross-sectional area of the through-hole 902*a* in square meter ($m^2$). l represents a length of the through-hole 902*a* in meter (m). δ represents a correction factor by an opening edge in meter (m). V represents a volume of the cavity 901*a* in cubic meter ($m^3$).

The air inside the through-hole 902*a* vibrates aggressively at a frequency near the resonance frequency. However, in a boundary layer in proximity to a wall of the through-hole 902*a*, the air serving as a fluid receives a viscous resistance. Accordingly, vibration energy is converted into thermal energy by the viscous resistance. Consequently, sound energy generated by the sonic wave that enters the Helmholtz resonator 900 from the outside thereof is converted into thermal energy, decreasing the sound energy and attaining sound absorption.

A description is provided of a construction to reduce noise that leaks from a comparative sheet conveying device.

The comparative sheet conveying device includes a sheet guide incorporating a resonant cavity disposed in a sheet ejection path. A duct is disposed in proximity to a sheet outlet. The resonant cavity adjoins an aperture disposed opposite a recording sheet. The duct attenuates noise that generates from a printing device and moves through the sheet ejection path adjoining the sheet outlet. The resonant cavity reduces the noise by using Helmholtz resonance.

However, due to the construction of the comparative sheet conveying device, the sheet guide incorporating the resonant cavity may not be situated appropriately relative to a sound source that generates the noise. Accordingly, the resonant cavity may reduce the noise locally and absorb the noise partially, reducing the noise ineffectively. The resonant cavity of the comparative sheet conveying device attenuates the noise generated by the printing device. Accordingly, the sound source that generates the noise (e.g., the printing device) is separated apart from a noise attenuator (e.g., the duct and the resonant cavity) that attenuates the noise in a recording medium conveyance direction. Accordingly, a part of the noise may diffuse inside the comparative sheet conveying device before the noise reaches the noise attenuator. Consequently, the noise attenuator may not attenuate the noise sufficiently.

To address the circumstance of the comparative sheet conveying device, the image forming apparatus 1 depicted in FIG. 1 includes a sheet conveying device 800 depicted in FIG. 2 and described below, which incorporates a noise attenuator (e.g., the noise attenuator 2) that attenuates slide noise that generates while a sheet (e.g., an original sheet, that is, the sheet S, and a recording sheet, that is, the sheet P) is conveyed through the sheet conveying device 800, for example, while the sheet S conveyed through the sheet conveying device 800 slides over a component disposed inside the sheet conveying device 800. The sheet conveying device 800 is installed in an image reading device (e.g., the image reading device 6) incorporating an auto document feeder (e.g., the ADF 5) or an image forming apparatus (e.g., the image forming apparatus 1) that forms an image on a recording medium according to image data created by the image reading device. Alternatively, the sheet conveying device 800 may be installed in an image forming apparatus that forms an image by inkjet printing or other machines that convey a sheet.

Figure 6:
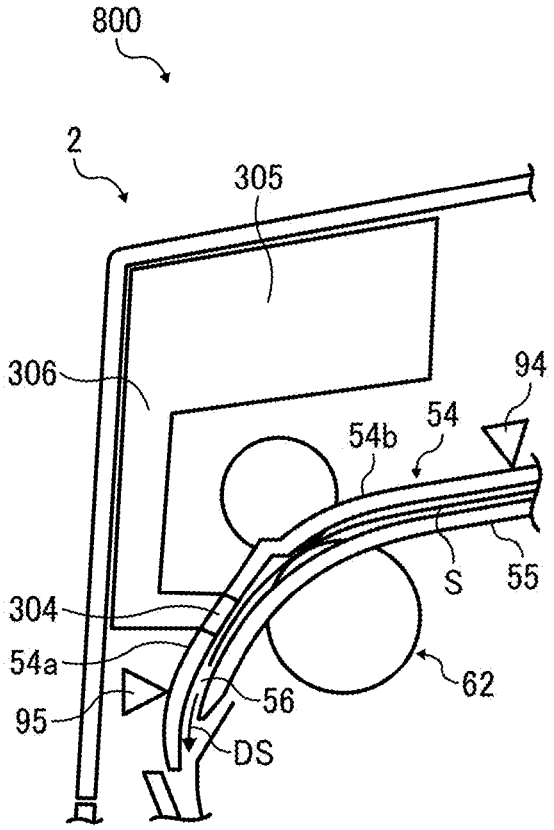
FIG. 6 is a cross-sectional view of a sheet conveying device incorporated in the auto document feeder depicted in FIG. 2, illustrating a noise attenuator.
Figure 7:
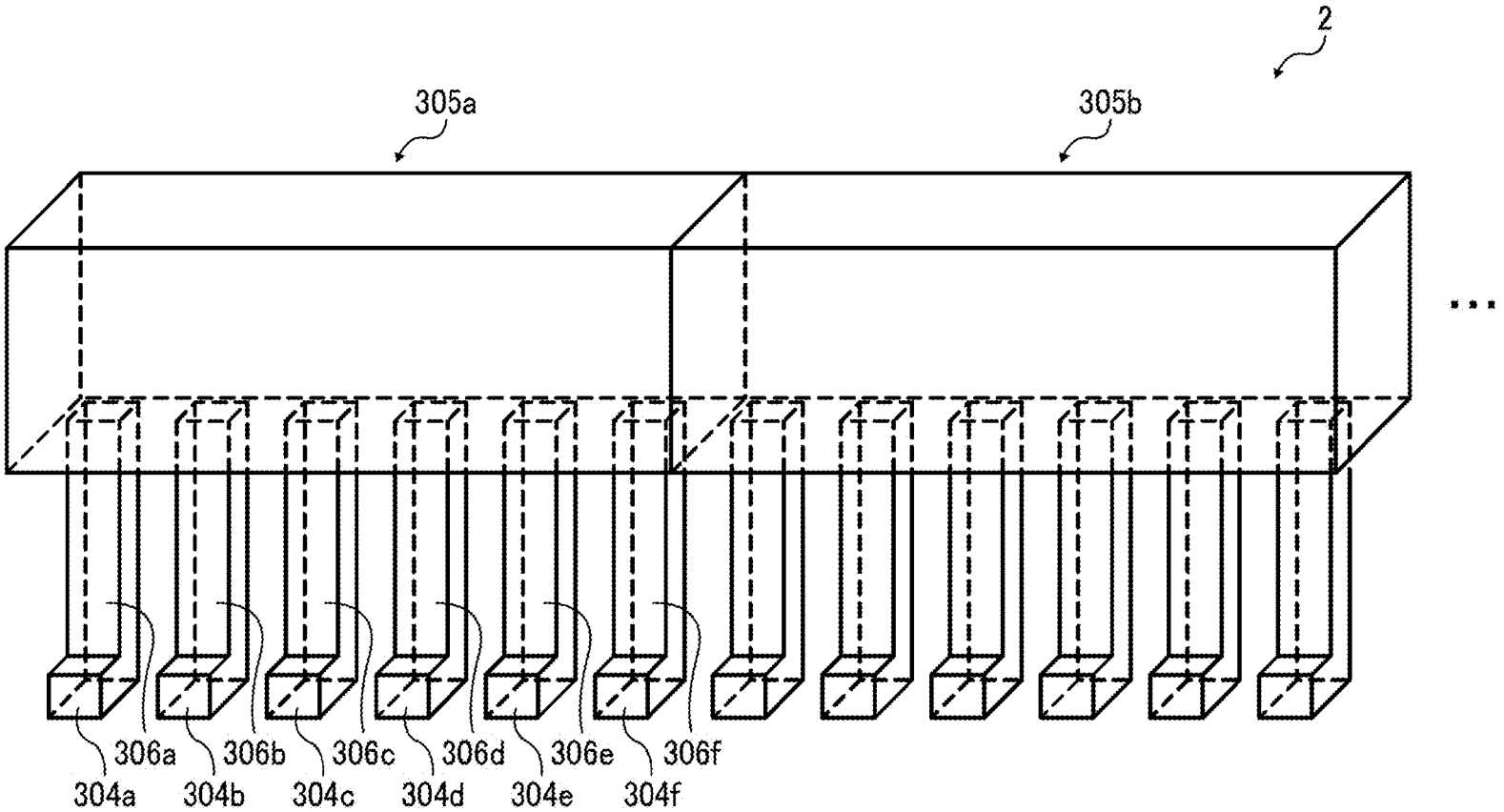
FIG. 7 is a perspective view of the noise attenuator depicted in FIG. 6.
Figure 8:
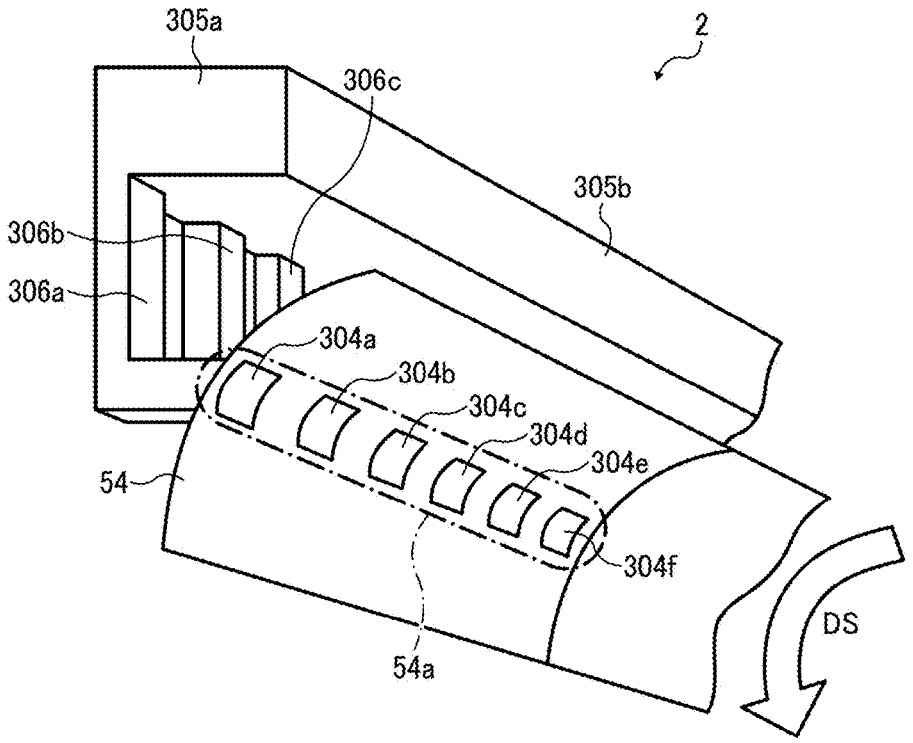
FIG. 8 is an exploded perspective view of the noise attenuator depicted in FIG. 6.

Referring to FIGS. 6 to 8, a description is provided of a construction of the noise attenuator 2 situated in the turn portion D depicted in FIG. 2.

FIG. 6 is a cross-sectional view of the sheet conveying device 800 incorporating the noise attenuator 2. FIG. 7 is a perspective view of the noise attenuator 2. FIG. 8 is an exploded perspective view of the noise attenuator 2. As illustrated in FIG. 6, the sheet conveying device 800 situated in the turn portion D of the ADF 5 depicted in FIG. 2 includes the pullout roller pair 61 depicted in FIG. 2 and the intermediate roller pair 62 that serve as a conveyer or an original conveyer that conveys the sheet S, a primary sheet guide 54 (e.g., a primary original guide), and a secondary sheet guide 55 (e.g., a secondary original guide) disposed opposite the primary sheet guide 54. The primary sheet guide 54 and the secondary sheet guide 55 define a sheet conveyance path 56, that is, an interval between the primary sheet guide 54 and the secondary sheet guide 55. The sheet conveyance path 56 directs the sheet S conveyed by the pullout roller pair 61 and the intermediate roller pair 62 in the given sheet conveyance direction DS.

The primary sheet guide 54 includes a bending portion 54*a* that bends the sheet S and changes the sheet conveyance direction DS. While the sheet S slides over the bending portion 54*a* with substantial friction, the bending portion 54*a* generates slide noise. Since the slide noise is propagated through an interval between the sheet S and the secondary sheet guide 55, the sheet conveying device 800 incorporates the noise attenuator 2. However, the turn portion D does not spare a space great enough to accommodate the noise attenuator 2 at a position disposed opposite an outer face of each of the primary sheet guide 54 and the secondary sheet guide 55 and disposed in proximity to each of the primary sheet guide 54 and the secondary sheet guide 55. In order to attenuate noise by Helmholtz resonance in a resonant cavity effectively, the resonant cavity is requested to have a given capacity or a given volume.

To address this request, the noise attenuator 2 depicted in FIGS. 6 to 8 may include a resonant cavity 305 disposed opposite the outer face of the primary sheet guide 54 or the secondary sheet guide 55 such that the resonant cavity 305 is disposed opposite the sheet conveyance path 56 via the primary sheet guide 54 or the secondary sheet guide 55. According to this example embodiment, the resonant cavity 305 serving as a Helmholtz resonator is disposed in a space above an outer face 54*b* of the primary sheet guide 54. The noise attenuator 2 further includes a sound inlet 304 and a sound guide 306. The sound inlet 304 is disposed in proximity to the bending portion 54*a*. The slide noise generated by the bending portion 54*a* moves to the resonant cavity 305 through the sound inlet 304. The sound guide 306 communicates with the sound inlet 304 and the resonant cavity 305 separated apart from the sound inlet 304 with a substantial distance therebetween.

The noise attenuator 2 may include at least one sound inlet 304, at least one sound guide 306, and at least one resonant cavity 305. According to this example embodiment, the noise attenuator 2 includes two resonant cavities 305, that is, a resonant cavity 305*a* and a resonant cavity 305*b* aligned with the resonant cavity 305*a* in the width direction of the sheet S perpendicular to the sheet conveyance direction DS as illustrated in FIG. 7. Each of the resonant cavity 305*a* and the resonant cavity 305*b* communicates with one end of each of six sound guides 306*a*, 306*b*, 306*c*, 306*d*, 306*e*, and 306*f* aligned in the width direction of the sheet S. Another end of each of the six sound guides 306*a*, 306*b*, 306*c*, 306*d*, 306*e*, and 306*f* communicates with six sound inlets 304*a*, 304*b*, 304*c*, 304*d*, 304*e*, and 304*f* aligned in the width direction of the sheet S. The six sound inlets 304*a*, 304*b*, 304*c*, 304*d*, 304*e*, and 304*f* are disposed opposite or abut on the bending portion 54*a* of the primary sheet guide 54 and aligned in the width direction of the sheet S.

Figure 9:
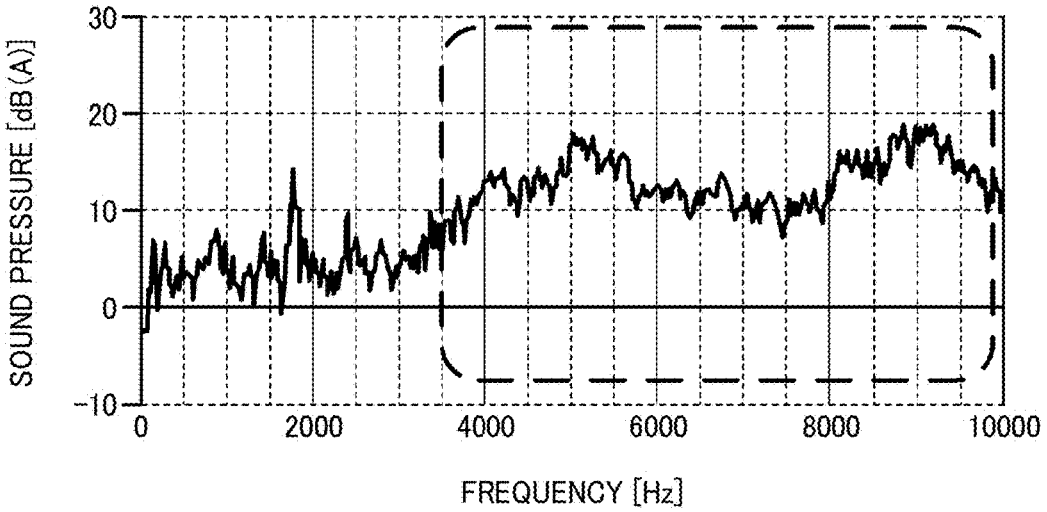
FIG. 9 is a graph illustrating a relation between a frequency of friction noise and a sound pressure level.

Since the slide noise generates by friction between the sheet S and the bending portion 54*a*, the slide noise is called friction noise. The friction noise does not have a particular frequency. FIG. 9 is a graph illustrating a relation between the frequency of the friction noise and the sound pressure level. As illustrated in FIG. 9, the friction noise has a broad frequency distribution not smaller than about 3.5 kHz. A human auditory sense is sensitive to a sound having a frequency near 4 kHz. For example, female scream and cry of a baby have the frequency near 4 kHz. If the sound having the frequency near 4 kHz is reduced, the noise attenuator 2 may achieve a substantial advantage against an A-weighting noise corrected for the human auditory sense. Accordingly, the shape of each of the sound inlet 304, the sound guide 306, and the resonant cavity 305 depicted in FIG. 6 is adjusted to attain the resonance frequency of about 4 kHz according to the formula (1) above.

A description is provided of an operation of the noise attenuator 2.

As illustrated in FIG. 6, the resonant cavity 305 is separated apart from the bending portion 54*a*. Since the resonant cavity 305 is separated apart from the sound inlet 304 with the substantial distance therebetween, the sound guide 306 communicates with the sound inlet 304 and the resonant cavity 305. Since the sound inlet 304 is in proximity to the bending portion 54*a*, the slide noise generated by the bending portion 54*a* enters the sound inlet 304 effectively before the slide noise diffuses. Thus, the sound inlet 304 intakes the slide noise effectively. While the slide noise having entered through the sound inlet 304 moves through the sound guide 306, the slide noise attenuates and enters the resonant cavity 305. The resonant cavity 305 attenuates the slide noise by Helmholtz resonance. Thus, even if there is not a space for the resonant cavity 305 at a position abutting on the bending portion 54*a* and therefore the resonant cavity 305 is separated apart from the bending portion 54*a*, the resonant cavity 305 attenuates the slide noise effectively.

A description is provided of a plurality of variations of the noise attenuator 2.

Figure 10:
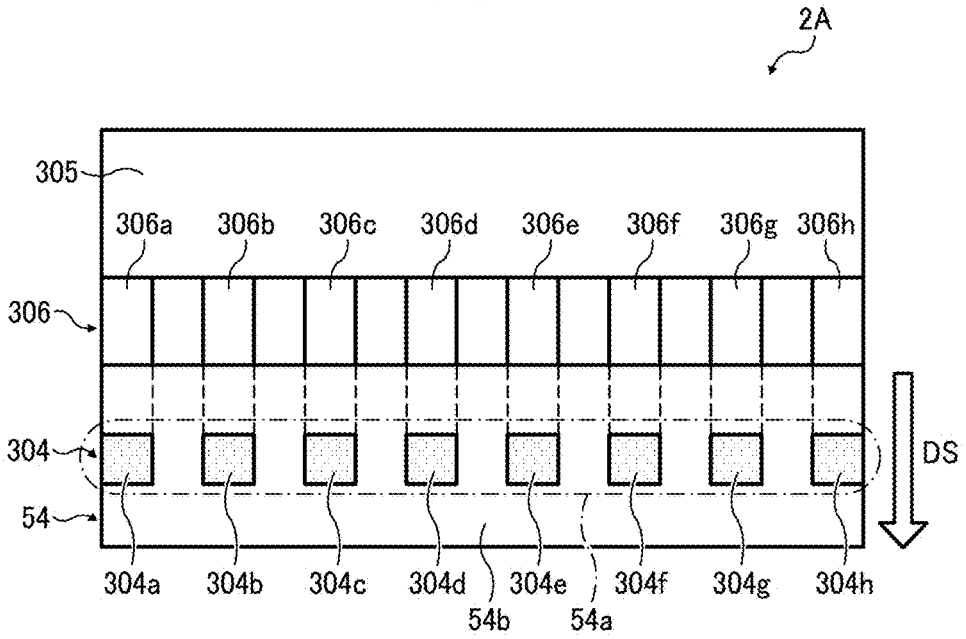
FIG. 10 is a cross-sectional view of a noise attenuator as a first variation of the noise attenuator depicted in FIG. 6.

FIG. 10 is a cross-sectional view of a noise attenuator 2A as a first variation of the noise attenuator 2. As illustrated in FIG. 10, the noise attenuator 2A includes the single resonant cavity 305 disposed above the primary sheet guide 54 and disposed opposite the outer face 54*b* of the primary sheet guide 54. The resonant cavity 305 communicates with one end of each of eight sound guides 306*a*, 306*b*, 306*c*, 306*d*, 306*e*, 306*f*, 306*g*, and 306*h*. Another end of each of the eight sound guides 306*a*, 306*b*, 306*c*, 306*d*, 306*e*, 306*f*, 306*g*, and 306*h* communicates with eight sound inlets 304*a*, 304*b*, 304*c*, 304*d*, 304*e*, 304*f*, 304*g*, and 304*h*, respectively, that are disposed opposite or abut on the bending portion 54*a* of the primary sheet guide 54.

Like the noise attenuator 2 depicted in FIG. 6, the noise attenuator 2A includes at least one sound inlet 304, at least one sound guide 306, and at least one resonant cavity 305. That is, the number of each of the sound inlet 304, the sound guide 306, and the resonant cavity 305 is not limited. As illustrated in FIG. 7, the noise attenuator 2 includes the two resonant cavities 305, that is, the resonant cavity 305*a* and the resonant cavity 305*b* abutting on or being aligned with the resonant cavity 305*a* in the width direction of the sheet S. The resonant cavities 305*a* and 305*b* may have an identical capacity or an identical volume to enhance the attenuation factor with respect to a target frequency, reducing the slide noise effectively. Alternatively, the resonant cavities 305*a* and 305*b* may have different capacities, respectively, to reduce the slide noise further for a broad frequency range.

Figure 11:
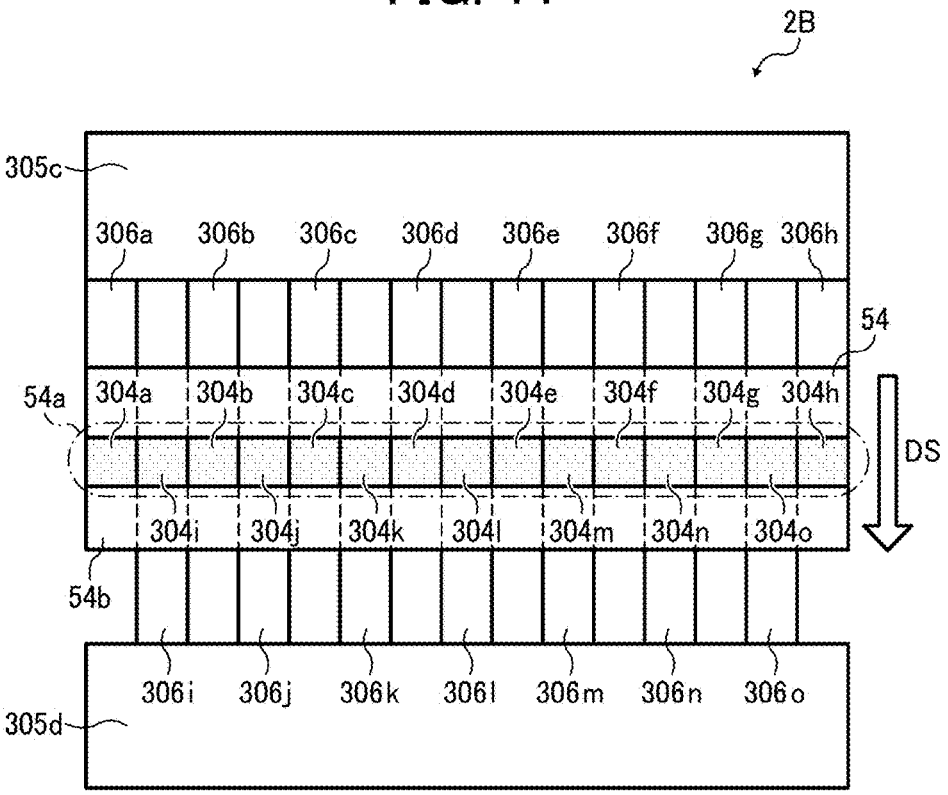
FIG. 11 is a cross-sectional view of a noise attenuator as a second variation of the noise attenuator depicted in FIG. 6.

FIG. 11 is a cross-sectional view of a noise attenuator 2B as a second variation of the noise attenuator 2. As illustrated in FIG. 11, the noise attenuator 2B includes a plurality of resonant cavities 305*c* and 305*d*. If there is a space above and below the primary sheet guide 54, the resonant cavities 305*c* and 305*d* are disposed above and below the primary sheet guide 54, respectively, and disposed opposite the outer face 54*b* of the primary sheet guide 54. The resonant cavity 305*d* is disposed downstream from the resonant cavity 305*c* in the sheet conveyance direction DS. The upper resonant cavity 305*c* communicates with one end of each of the eight sound guides 306*a*, 306*b*, 306*c*, 306*d*, 306*e*, 306*f*, 306*g*, and 306*h*. The lower resonant cavity 305*d* communicates with one end of each of seven sound guides 306*i*, 306*j*, 306*k*, 306*l*, 306*m*, 306*n*, and 306*o*. Another end of each of the eight sound guides 306*a*, 306*b*, 306*c*, 306*d*, 306*e*, 306*f*, 306*g*, and 306*h* communicates with the eight sound inlets 304*a*, 304*b*, 304*c*, 304*d*, 304*e*, 304*f*, 304*g*, and 304*h*, respectively, that are disposed opposite or abut on the bending portion 54*a* of the primary sheet guide 54. Another end of each of the seven sound guides 306*i*, 306*j*, 306*k*, 306*l*, 306*m*, 306*n*, and 306*o* communicates with seven sound inlets 304*i*, 304*j*, 304*k*, 304*l*, 304*m*, 304*n*, and 304*o*, respectively, that are disposed opposite the bending portion 54*a* of the primary sheet guide 54. Thus, the eight sound inlets 304*a*, 304*b*, 304*c*, 304*d*, 304*e*, 304*f*, 304*g*, and 304*h* are arranged alternately with the seven sound inlets 304*i*, 304*j*, 304*k*, 304*l*, 304*m*, 304*n*, and 304*o*, respectively, in the width direction of the sheet S perpendicular to the sheet conveyance direction DS.

Accordingly, the fifteen sound inlets 304*a*, 304*b*, 304*c*, 304*d*, 304*e*, 304*f*, 304*g*, 304*h*, 304*i*, 304*j*, 304*k*, 304*l*, 304*m*, 304*n*, and 304*o* (hereinafter referred to as the sound inlets 304) are arranged closely to each other in the width direction of the sheet S and disposed opposite the bending portion 54*a* serving as a sound source that generates the slide noise. The noise attenuator 2B does not have a non-inlet that does not intake the slide noise and is interposed between the adjacent sound inlets 304. The sound inlets 304 aligned closely to each other in the width direction of the sheet S are disposed opposite the sound source (e.g., the bending portion 54*a*) to intake the slide noise before the slide noise diffuses. Accordingly, the noise attenuator 2B reduces the slide noise substantially with the resonant cavities 305*c* and 305*d* that have the identical capacity without increasing the number and the capacity of the resonant cavities 305*c* and 305*d*.

A description is provided of the shape of the sound guide 306.

Figure 12A:
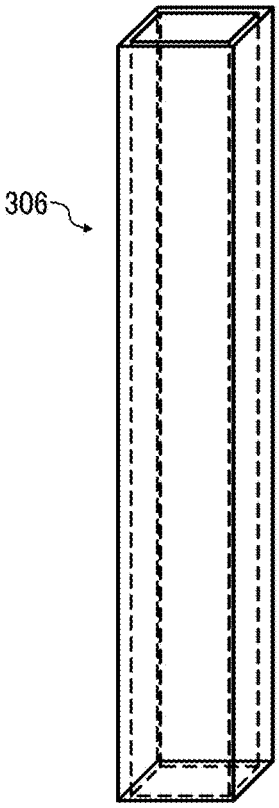
FIG. 12A is a perspective view of a sound guide as a rectangular tube incorporated in the noise attenuator depicted in FIG. 6.
Figure 12B:
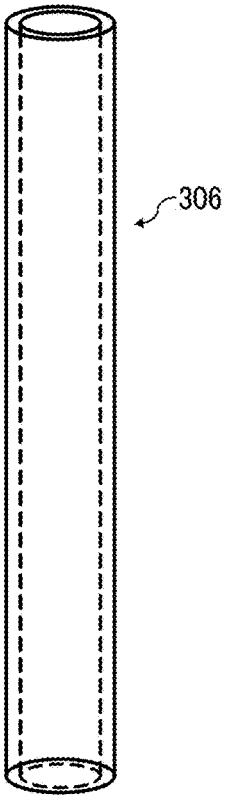
FIG. 12B is a perspective view of a sound guide as a circular tube incorporated in the noise attenuator depicted in FIG. 6.

FIG. 12A is a perspective view of the sound guide 306 as a rectangular tube. FIG. 12B is a perspective view of the sound guide 306 as a circular tube. As illustrated in FIG. 12A, the sound guide 306 is made of resin and is a straight tube having a rectangular cross-section. As illustrated in FIG. 12B, the sound guide 306 is made of resin and is a cylinder or a straight tube having a circular cross-section. Alternatively, the sound guide 306 may not be the straight tube. The sound guide 306 may have any shape that does not prohibit air from flowing into the resonant cavity 305. For example, the sound guide 306 may be a curved tube curved according to a space between the sound inlet 304 and the resonant cavity 305. The sound guide 306 may have different cross-sections that are interposed between the sound inlet 304 and the resonant cavity 305. For example, the sound guide 306 may be a tube having a cross-section that changes from a rectangle to a circle or from a circle to a rectangle. The sound guide 306 has flexibility in the arrangement in space, the size in cross-section, and the shape in cross-section.

A description is provided of a plurality of variations of the sound guide 306.

Figure 13:
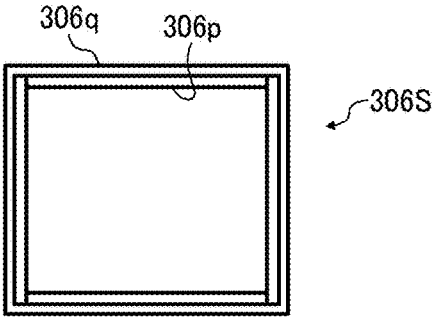
FIG. 13 is a cross-sectional view of a sound guide as a first variation of the sound guide depicted in FIG. 12A.

FIG. 13 is a cross-sectional view of a sound guide 306S as a first variation of the sound guide 306. As illustrated in FIG. 13, the sound guide 306S includes a porous plastic portion 306*p* and a crust 306*q* surrounding the porous plastic portion 306*p*. The crust 306*q* is a tube that is rectangular in cross-section and made of resin. The porous plastic portion 306*p* is a plate attached to a whole interior face of the crust 306*q* that is rectangular in cross-section. The porous plastic portion 306*p* has an open cell structure made of polyurethane foam or the like.

Figure 14:
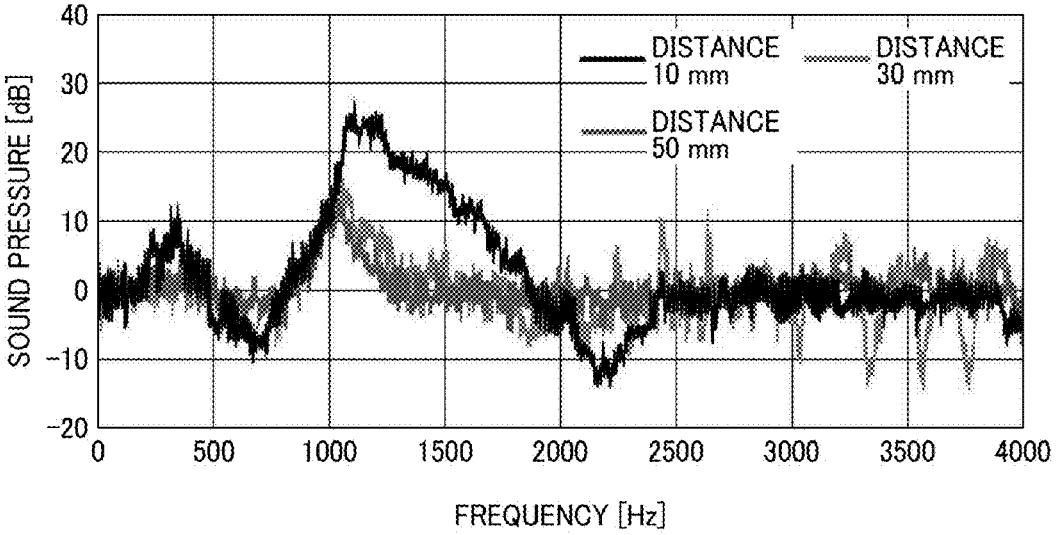
FIG. 14 is a graph illustrating noise reduction by Helmholtz resonance with the sound guide depicted in FIG. 13.

FIG. 14 is a graph illustrating a relation between the frequency of the friction noise and the sound pressure level. FIG. 14 illustrates noise reduction by Helmholtz resonance with the sound guide 306S depicted in FIG. 13. In FIG. 14, a dark line illustrates noise reduction by Helmholtz resonance with the sound guide 306S incorporating the porous plastic portion 306*p*. A light line illustrates noise reduction by Helmholtz resonance with a sound guide not incorporating the porous plastic portion 306*p*. The porous plastic portion 306*p* of the sound guide 306S converts the slide noise into thermal energy by the viscous resistance against the slide noise, improving attenuation of vibration of the slide noise that moves from the sound inlet 304 to the resonant cavity 305 and reducing the slide noise effectively.

Figure 15:
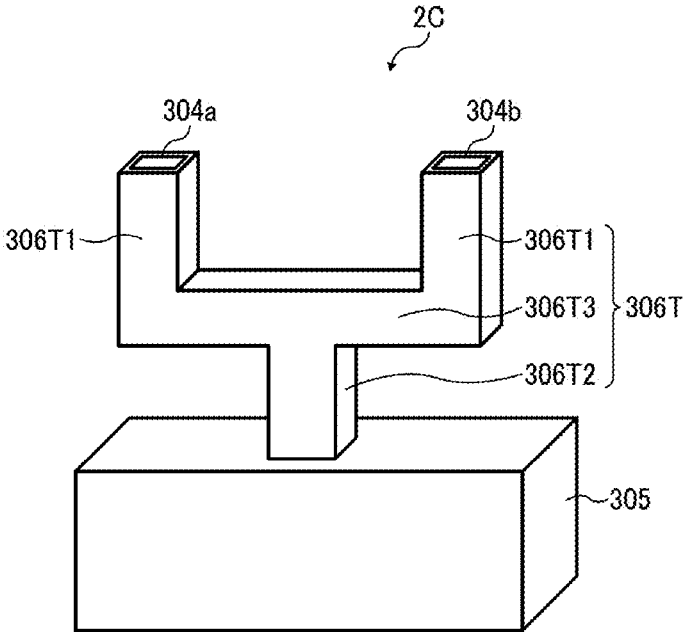
FIG. 15 is a perspective view of a noise attenuator incorporating a sound guide as a second variation of the sound guide depicted in FIG. 12A.

FIG. 15 is a perspective view of a noise attenuator 2C incorporating a sound guide 306T as a second variation of the sound guide 306. As illustrated in FIG. 15, the sound guide 306T includes two first end portions 306T1 disposed at one end of the sound guide 306T, a second end portion 306T2 disposed at another end of the sound guide 306T, and an intermediate portion 306T3 interposed between the first end portions 306T1 and the second end portion 306T2. The first end portions 306T1 adjoin the two sound inlets 304*a* and 304*b*, respectively. The intermediate portion 306T3 bridges the two first end portions 306T1 and serves as a joint that combines the two first end portions 306T1. The second end portion 306T2 adjoins the intermediate portion 306T3 and the single resonant cavity 305. Thus, the sound guide 306T is bifurcate.

If there is a space spared for the sound guide 306 at a position disposed opposite the outer face of the secondary sheet guide 55, the sound inlet 304 is not disposed opposite the bending portion 54*a* of the primary sheet guide 54 directly but the sound inlet 304 is disposed opposite the bending portion 54*a* of the primary sheet guide 54 via the secondary sheet guide 55. For example, the sound inlet 304 abuts on a bending portion of the secondary sheet guide 55.

As illustrated in FIG. 6, the bending portion 54*a* is disposed at a portion of the primary sheet guide 54 where the primary sheet guide 54 has a decreased radius of curvature. Alternatively, the bending portion 54*a* may be a curved portion that contacts the sheet S linearly. The noise attenuators 2, 2A, 2B, and 2C are disposed opposite the bending portion 54*a* situated in the turn portion D of the ADF 5 depicted in FIG. 2. Alternatively, the noise attenuators 2, 2A, 2B, and 2C may be disposed opposite a bending portion situated at a position other than the turn portion D.

A description is provided of advantages of a sheet conveying device (e.g., the sheet conveying device 800).

As illustrated in FIG. 6, the sheet conveying device includes a conveyer (e.g., the pullout roller pair 61, the intermediate roller pair 62, the pickup roller 58, or the feed belt 59), a primary sheet guide (e.g., the primary sheet guide 54), a secondary sheet guide (e.g., the secondary sheet guide 55), a sheet conveyance path (e.g., the sheet conveyance path 56), and a noise attenuator (e.g., the noise attenuators 2, 2A, 2B, and 2C). The conveyer conveys a sheet (e.g., the sheet S serving as an original sheet or the sheet P serving as a recording sheet). The secondary sheet guide is disposed opposite the primary sheet guide with an interval therebetween to define the sheet conveyance path. The sheet conveyance path conveys the sheet conveyed by the conveyer in a sheet conveyance direction (e.g., the sheet conveyance direction DS). The primary sheet guide or the secondary sheet guide includes a bending portion (e.g., the bending portion 54*a*) that bends the sheet and changes the sheet conveyance direction. The noise attenuator intakes and attenuates slide noise generated by the bending portion while the sheet slides over the bending portion. The noise attenuator includes at least one resonant cavity, at least one sound inlet, and at least one sound guide. The resonant cavity is disposed opposite an outer face (e.g., the outer face 54*b*) of the primary sheet guide or the secondary sheet guide. The sound inlet is disposed in proximity to the bending portion of the primary sheet guide or the secondary sheet guide to intake the slide noise generated by the bending portion. The sound guide communicates with the sound inlet and the resonant cavity to guide the slide noise from the sound inlet to the resonant cavity.

Accordingly, even if there is not a space great enough to accommodate the resonant cavity of the noise attenuator such that the resonant cavity abuts on the bending portion serving as a sound source of the slide noise that generates while the sheet is conveyed over the bending portion, the resonant cavity great enough to attenuate the slide noise is connected to the bending portion through the sound guide although the resonant cavity is separated apart from the bending portion. Consequently, the sheet conveying device incorporating the noise attenuator reduces the slide noise effectively. The sheet conveying device is installed in the ADF 5 or the image forming apparatus 1.

As described above, the bending portion of the primary sheet guide is a sound source that generates the slide noise while the sheet slides over the bending portion. The primary sheet guide and the secondary sheet guide define the sheet conveyance path. Even if there is not the space great enough to accommodate the resonant cavity that abuts on the sound source, the noise attenuator is disposed opposite the sound source. The noise attenuator includes a plurality of sound inlets (e.g., the sound inlets 304), the resonant cavity separated apart from the sound source, and the sound guide that couples the sound inlets to the resonant cavity. Accordingly, before the slide noise generated by the sound source diffuses, the sound inlets intake the slide noise. The sound guide attenuates the slide noise while the slide noise moves through the sound guide to the resonant cavity. The resonant cavity attenuates the slide noise by Helmholtz resonance. Thus, even if there is not the space great enough to accommodate the resonant cavity that abuts on the sound source, the noise attenuator reduces the slide noise substantially. The noise attenuator is installed in the sheet conveying device.

The present disclosure has been described above with reference to specific example embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative example embodiments may be combined with each other and/or substituted for each other within the scope of the present disclosure.

What is claimed is:

1. A sheet conveying device comprising:

a conveyer to convey a sheet;

a primary sheet guide including a bending portion to bend the sheet while the sheet slides over the bending portion to change a sheet conveyance direction;

a secondary sheet guide disposed opposite the primary sheet guide with an interval between the primary sheet guide and the secondary sheet guide; and a noise attenuator to intake and attenuate slide noise generated by the bending portion while the sheet slides over the bending portion, the noise attenuator including:

at least one resonant cavity disposed opposite an outer face of one of the primary sheet guide and the secondary sheet guide;

at least one sound inlet, disposed in proximity to the bending portion, to intake the slide noise generated by the bending portion; and at least one sound guide communicating with the sound inlet and the resonant cavity to guide the slide noise from the sound inlet to the resonant cavity.

2. The sheet conveying device according to claim 1, wherein the primary sheet guide and the secondary sheet guide define a sheet conveyance path through which the sheet is conveyed in the sheet conveyance direction.

3. The sheet conveying device according to claim 1, wherein the at least one resonant cavity includes:

a first resonant cavity having a first capacity; and a second resonant cavity having a second capacity and abutting on the first resonant cavity.

4. The sheet conveying device according to claim 3, wherein the first capacity of the first resonant cavity is different from the second capacity of the second resonant cavity.

5. The sheet conveying device according to claim 3, wherein the first capacity of the first resonant cavity is identical to the second capacity of the second resonant cavity.

6. The sheet conveying device according to claim 3, wherein the at least one sound inlet includes:

a first sound inlet; and a second sound inlet aligned with the first sound inlet in a width direction of the sheet that is perpendicular to the sheet conveyance direction, and wherein the at least one sound guide includes:

a first sound guide communicating with the first sound inlet; and a second sound guide communicating with the second sound inlet and aligned with the first sound guide in the width direction of the sheet.

7. The sheet conveying device according to claim 6, wherein the first resonant cavity communicates with the first sound guide and the second sound guide.

8. The sheet conveying device according to claim 6, wherein the at least one sound inlet further includes:

a third sound inlet; and a fourth sound inlet aligned with the third sound inlet in the width direction of the sheet, and wherein the at least one sound guide further includes:

a third sound guide communicating with the third sound inlet; and a fourth sound guide communicating with the fourth sound inlet and aligned with the third sound guide in the width direction of the sheet.

9. The sheet conveying device according to claim 8, wherein the second resonant cavity communicates with the third sound guide and the fourth sound guide.

10. The sheet conveying device according to claim 9, wherein the first resonant cavity is aligned with the second resonant cavity in the width direction of the sheet.

11. The sheet conveying device according to claim 9, wherein the second resonant cavity is disposed downstream from the first resonant cavity in the sheet conveyance direction, and wherein the first sound inlet and the second sound inlet are arranged alternately with the third sound inlet and the fourth sound inlet, respectively, in the width direction of the sheet.

12. The sheet conveying device according to claim 1, wherein the sound guide includes:

a porous plastic portion having an open cell structure; and a crust including a tube surrounding the porous plastic portion.

13. The sheet conveying device according to claim 12, wherein the tube of the crust is rectangular in cross-section and made of resin.

14. The sheet conveying device according to claim 12, wherein the porous plastic portion includes a plate attached to the crust and made of polyurethane foam.

15. The sheet conveying device according to claim 1, wherein the sound guide has a plurality of different cross-sections interposed between the sound inlet and the resonant cavity.

16. The sheet conveying device according to claim 1, wherein the at least one sound inlet includes two sound inlets, and wherein the sound guide includes:

two first end portions disposed at one end of the sound guide and adjoining the two sound inlets, respectively;

a second end portion disposed at another end of the sound guide and adjoining the resonant cavity; and an intermediate portion interposed between the two first end portions and the second end portion and bridging the two first end portions.

17. The sheet conveying device according to claim 1, wherein the sound guide includes a tube having a rectangular cross-section.

18. The sheet conveying device according to claim 1, wherein the sound guide includes a tube having a circular cross-section.

19. A sheet feeder comprising:

a roller pair to feed a sheet; and a sheet conveying device to convey the sheet fed by the roller pair, the sheet conveying device including:

a conveyer to convey the sheet;

a primary sheet guide including a bending portion to bend the sheet while the sheet slides over the bending portion to change a sheet conveyance direction;

a secondary sheet guide disposed opposite the primary sheet guide with an interval between the primary sheet guide and the secondary sheet guide; and a noise attenuator to intake and attenuate slide noise generated by the bending portion while the sheet slides over the bending portion, the noise attenuator including:

at least one resonant cavity disposed opposite an outer face of one of the primary sheet guide and the secondary sheet guide;

at least one sound inlet, disposed in proximity to the bending portion, to intake the slide noise generated by the bending portion; and at least one sound guide communicating with the sound inlet and the resonant cavity to guide the slide noise from the sound inlet to the resonant cavity.

20. An image forming apparatus comprising:

an image scanner to read an image on a sheet; and a sheet conveying device to convey the sheet to the image scanner, the sheet conveying device including:

a conveyer to convey the sheet;

a primary sheet guide including a bending portion to bend the sheet while the sheet slides over the bending portion to change a sheet conveyance direction;

a secondary sheet guide disposed opposite the primary sheet guide with an interval between the primary sheet guide and the secondary sheet guide; and a noise attenuator to intake and attenuate slide noise generated by the bending portion while the sheet slides over the bending portion, the noise attenuator including:

at least one resonant cavity disposed opposite an outer face of one of the primary sheet guide and the secondary sheet guide;

at least one sound inlet, disposed in proximity to the bending portion, to intake the slide noise generated by the bending portion; and at least one sound guide communicating with the sound inlet and the resonant cavity to guide the slide noise from the sound inlet to the resonant cavity.

* * * * *